US012029271B2

(12) United States Patent
Isobe

(10) Patent No.: US 12,029,271 B2
(45) Date of Patent: Jul. 9, 2024

(54) SHIELD LOCK MECHANISM AND HELMET

(71) Applicant: SHOEI CO., LTD., Tokyo (JP)

(72) Inventor: Eiji Isobe, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 0 days.

(21) Appl. No.: 17/781,590

(22) PCT Filed: Oct. 8, 2020

(86) PCT No.: PCT/JP2020/038180
§ 371 (c)(1),
(2) Date: Jun. 1, 2022

(87) PCT Pub. No.: WO2021/152921
PCT Pub. Date: Aug. 5, 2021

(65) Prior Publication Data

US 2022/0408868 A1 Dec. 29, 2022

(30) Foreign Application Priority Data

Jan. 29, 2020 (JP) ..... 2020-012269

(51) Int. Cl.
*A42B 3/22* (2006.01)

(52) U.S. Cl.
CPC ..... *A42B 3/222* (2013.01)

(58) Field of Classification Search
CPC ..... A42B 3/222; A42B 3/22; A42B 3/221; A42B 3/224; A42B 3/185; A42B 3/226
See application file for complete search history.

(56) References Cited

U.S. PATENT DOCUMENTS

2002/0189005 A1 12/2002 Taniuchi
2008/0141443 A1 6/2008 Arai
2009/0038057 A1* 2/2009 Tews ..... A42B 3/223 2/427

FOREIGN PATENT DOCUMENTS

JP 200080517 A 3/2000
JP 2002339142 A 11/2002
JP 2008150718 A 7/2008
JP 201611473 A 1/2016

OTHER PUBLICATIONS

International Search Report for Application No. PCT/JP2020/038180 mailed Dec. 15, 2020, 2 pages.

* cited by examiner

*Primary Examiner* — Heather Mangine
*Assistant Examiner* — Erick I Lopez
(74) *Attorney, Agent, or Firm* — CANTOR COLBURN LLP

(57) ABSTRACT

A shield lock mechanism for attachment to a shell includes a holding member configured to be moved by an external operation between a holding position at which a shield is held and an attachment-detachment position at which the shield can be attached or detached, a biasing member configured to constantly bias the holding member toward the holding position, and a restriction member configured to be moved by an external operation between a restricting position at which movement of the holding member arranged at the holding position is restricted and a cancelling position at which the restriction is cancelled.

7 Claims, 5 Drawing Sheets

SHIELD LOCK MECHANISM AND HELMET

TECHNICAL FIELD

The present disclosure relates to a shield lock mechanism that is for attachment to a shell and a helmet.

BACKGROUND ART

A known helmet includes an attachment-detachment mechanism that allows a shield to be attached and detached by performing an operation from outside the helmet. The attachment-detachment mechanism includes an attachment-detachment member that is moved between a shield holding position and a shield removable position. The attachment-detachment member is biased to the shield holding position by a biasing member and moved to the shield removable position when an operation force that counters the biasing force is applied from outside the helmet (for example, Patent Literature 1).

CITATION LIST

Patent Literature

Patent Literature 1: Japanese Laid-Open Patent Publication No. 2002-339142

SUMMARY OF INVENTION

Technical Problem

In the attachment-detachment mechanism, when a strong impact is applied to the helmet, inertial force that counters the biasing force acts on the attachment-detachment member may move the attachment-detachment member from the shield holding position to the shield removable position in an unexpected manner.

An objective of the present disclosure is to provide a shield lock mechanism and a helmet that avoids a situation in which a holding member that holds the shield is moved by an impact.

Solution to Problem

A shield lock mechanism in accordance with the present disclosure is for attachment to a shell. The shield lock mechanism includes a holding member, a biasing member, and a restriction member. The holding member is configured to be moved by an external operation between a holding position at which a shield is held and an attachment-detachment position at which the shield can be attached and detached. The biasing member is configured to constantly bias the holding member toward the holding position. The restriction member is configured to be moved by an external operation between a restricting position at which movement of the holding member arranged at the holding position is restricted and a canceling position at which the restriction is canceled.

A helmet in accordance with the present disclosure includes a shell, a shield, and the above-described shield lock mechanism.

DESCRIPTION OF EMBODIMENT

An embodiment of a shield lock mechanism will now be described with reference to FIGS. 1 to 7. In FIGS. 1 to 7, the front, rear, left, right, up, and down directions with respect to a helmet and the shield lock mechanism correspond to the directions as viewed by a person wearing the helmet.

Helmet

Figure 1:
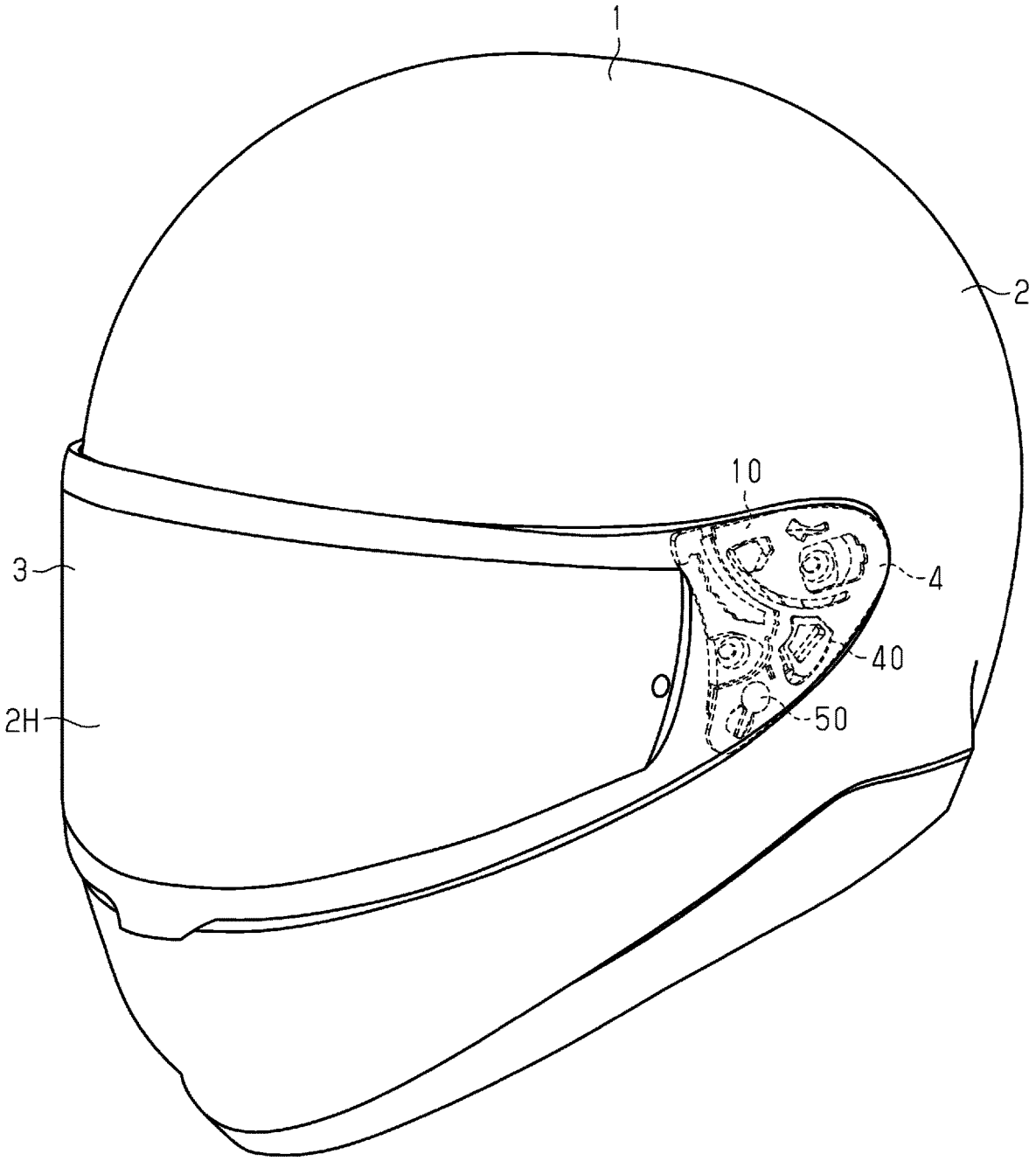
FIG. 1 is a perspective view showing a shield lock mechanism according to an embodiment and a helmet including the shield lock mechanism.

As shown in FIG. 1, a helmet 1 includes a shell 2, a shield 3, and a shield lock mechanism 4. A wearer of the helmet 1 wears the shell 2 on the head. The shell 2 has a window opening 2H. The window opening 2H ensures the field of view of the helmet wearer. The shield 3 is light-transmissive. When the window opening 2H is closed with the shield 3, the shield 3 protects the head of the helmet wearer while maintaining the field of view of the helmet wearer. The shield 3 is attached to a left side surface of the shell 2 by the shield lock mechanism 4 such that the shield lock mechanism 4 is sandwiched between the shield 3 and the shell 2.

Figure 2:
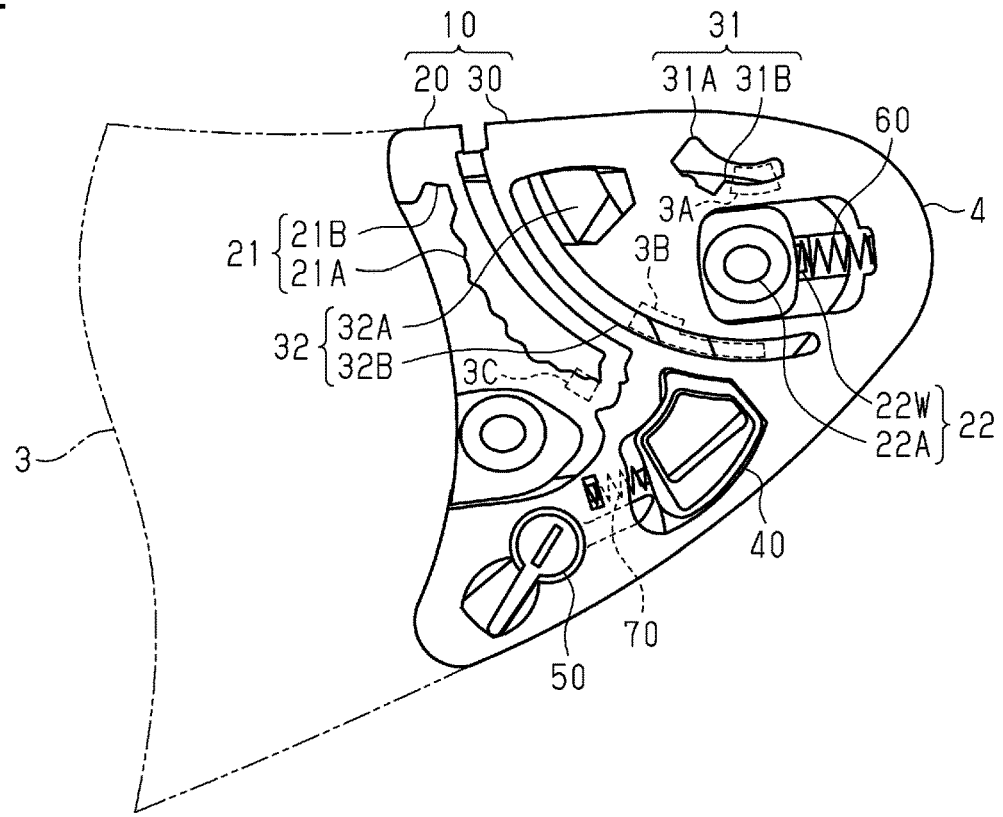
FIG. 2 is a front view of the shield lock mechanism shown in FIG. 1 in a state in which a shield is in a fully closed position.

As shown in FIG. 2, the shield lock mechanism 4 includes a base plate 10, a holding member 40, a restriction member 50, a first coil spring 60, and a second coil spring 70. The second coil spring 70 is an example of a biasing member.

The base plate 10 includes two bases. Each base is a plate that is curved in correspondence with the left side surface of the shell 2. The two bases include a fixed base 20 and a movable base 30. The fixed base 20 is fixed on the left side surface of the shell 2. The movable base 30 is arranged to cover a left portion of the fixed base 20. The movable base 30 is connected to the fixed base 20 in a manner movable in forward and rearward directions.

Figure 4:
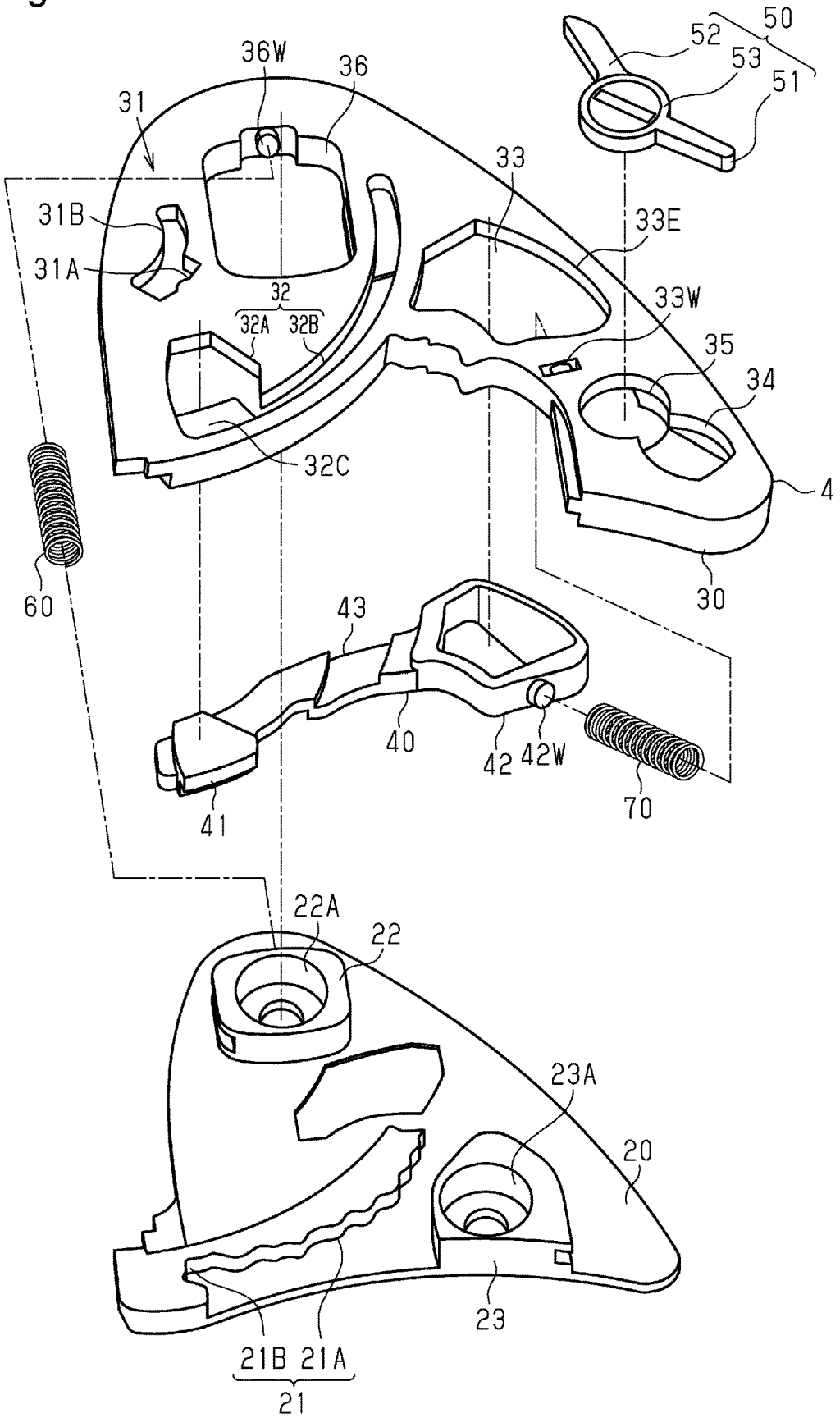
FIG. 4 is an exploded perspective view of the shield lock mechanism shown in FIG. 1.

The fixed base 20 and the movable base 30 sandwich part of the holding member 40 (refer to FIG. 4), part of the restriction member 50 (refer to FIG. 4), and part of the second coil spring 70 (refer to FIG. 4). The first coil spring 60 extends in the front-rear direction and is connected between the fixed base 20 and the movable base 30. The first coil spring 60 is in contact with the fixed base 20 and the movable base 30 and constantly biases the movable base 30 toward the rear of the helmet wearer.

Base Plate

The base plate 10 includes a first engagement hole 31, a second engagement hole 32, and an opening degree determination portion 21.

The first engagement hole 31 includes a first attachment-detachment hole 31A and a first guide hole 31B. The first attachment-detachment hole 31A is a substantially rectangular small hole extending through a portion of the movable base 30 peripheral to the upper end of the movable base 30.

The first guide hole 31B is an elongated hole extending through a portion of the movable base 30 peripheral to the upper end of the movable base 30. The first guide hole 31B extends rearward from the first attachment-detachment hole 31A in an arcuate manner.

The shield 3 includes a first engagement tab 3A projecting toward the fixed base 20. The first engagement tab 3A has a claw-shaped distal end that is bent downward. The distal end of the first engagement tab 3A is sized to enter the space between the fixed base 20 and the movable base 30 through the first attachment-detachment hole 31A. Further, the distal end of the first engagement tab 3A is sized to be removable from between the fixed base 20 and the movable base 30 through the first attachment-detachment hole 31A. The first engagement tab 3A has a thickness such that the first engagement tab 3A is slidable in the first guide hole 31B along the first guide hole 31B. The thickness of the first engagement tab 3A corresponds to the amount of the first engagement tab 3A extending from the shield 3 toward the fixed base 20 such that the first engagement tab 3A is slidable in the first guide hole 31B. The first guide hole 31B guides the movement of the first engagement tab 3A in the direction in which the first guide hole 31B extends. The first engagement tab 3A is guided by the first guide hole 31B so that the shield 3 is stably opened and closed.

The second engagement hole 32 includes a second attachment-detachment hole 32A and a second guide hole 32B. The second attachment-detachment hole 32A (refer to FIG. 4) is a substantially rectangular hole extending through a portion of the movable base 30 peripheral to the upper end of the movable base 30 in front of the first attachment-detachment hole 31A. The second attachment-detachment hole 32A is larger than the first attachment-detachment hole 31A. The second guide hole 32B is an elongated hole extending through the movable base 30. The second guide hole 32B extends in an arcuate manner from the second attachment-detachment hole 32A toward the rear lower end of the movable base 30.

The shield 3 includes a second engagement tab 3B projecting toward the fixed base 20. The second engagement tab 3B has a claw-shaped distal end that is bent upward and rearward. The distal end of the second engagement tab 3B is sized to enter the space between the fixed base 20 and the movable base 30 through the second attachment-detachment hole 32A. Further, the distal end of the second engagement tab 3B is sized to be removable from between the fixed base 20 and the movable base 30 through the second attachment-detachment hole 32A. The second engagement tab 3B has a thickness such that the second engagement tab 3B is slidable in the second guide hole 32B along the second guide hole 32B. The thickness of the second engagement tab 3B corresponds to the amount of the second engagement tab 3B extending from the shield 3 toward the fixed base 20 such that the second engagement tab 3B is slidable in the second guide hole 32B. The second guide hole 32B guides the movement of the second engagement tab 3B in the direction in which the second guide hole 32B extends. The second engagement tab 3B is guided by the second guide hole 32B so that the shield 3 is stably opened and closed.

The opening degree determination portion 21 is located at a portion of the fixed base 20 that is not covered by the movable base 30. The opening degree determination portion 21 includes a multi-serrated engagement portion 21A and an attachment-detachment stepped portion 21B arranged on the fixed base 20. The multi-serrated engagement portion 21A extends in an arcuate manner from the front upper end of the fixed base 20 toward the rear lower end of the fixed base 20. The multi-serrated engagement portion 21A includes ridges that project toward the front and valleys that are recessed toward the rear, and the ridges and the valleys are alternately arranged along the multi-serrated engagement portion 21A. The attachment-detachment stepped portion 21B is an upwardly extending recess that is continuous with the upper end of the multi-serrated engagement portion 21A.

The shield 3 includes an opening degree adjustment projection 3C projecting toward the fixed base 20. The opening degree adjustment projection 3C is sized to move into the valleys of the multi-serrated engagement portion 21A and the recess of the attachment-detachment stepped portion 21B. Further, the opening degree adjustment projection 3C is flexible so that the opening degree adjustment projection 3C moves over the ridges of the multi-serrated engagement portion 21A one at a time when opening or closing the shield 3. When the first engagement tab 3A is moved in the first guide hole 31B and the second engagement tab 3B is moved in the second guide hole 32B, the opening degree adjustment projection 3C enters one of the valleys of the multi-serrated engagement portion 21A and fixes the opening degree of the shield 3. Further, as shown in FIG. 3, when the opening degree adjustment projection 3C enters the attachment-detachment stepped portion 21B of the fixed base 20, the shield 3 is in a fully open position.

As shown in FIG. 2, when the shield 3 is in a fully closed position, the first engagement tab 3A is in the first guide hole 31B and the second engagement tab 3B is in the second guide hole 32B. This holds the shield 3 with the base plate 10. Also, the opening degree adjustment projection 3C is in the lowest valley of the multi-serrated engagement portion 21A. This fixes the shield 3 in the fully closed position. When the shield 3 is operated and opened from this state, the first engagement tab 3A is moved along the first guide hole 31B, the second engagement tab 3B is moved along the second guide hole 32B, and the opening degree adjustment projection 3C is moved over the ridges of the multi-serrated engagement portion 21A one at a time. This intermittently fixes the opening degree of the shield 3.

Figure 3:
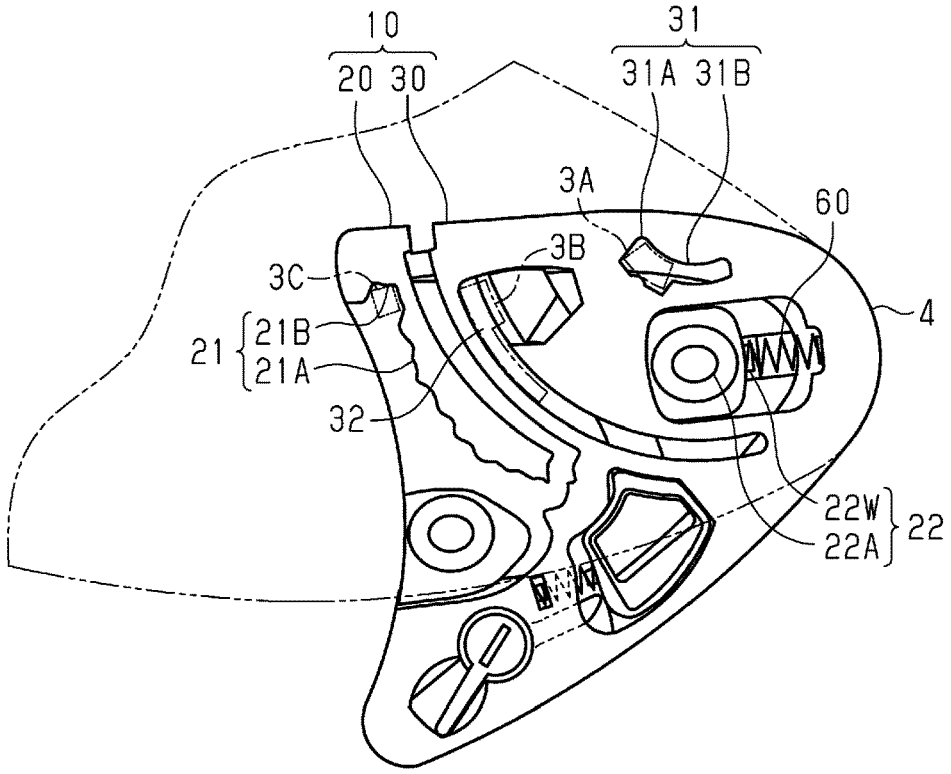
FIG. 3 is a front view of the shield lock mechanism shown in FIG. 1 in a state in which the shield is in a fully open position.

As shown in FIG. 3, when the shield 3 reaches the fully open position, the first engagement tab 3A is in the first attachment-detachment hole 31A and the second engagement tab 3B is in the second attachment-detachment hole 32A. Further, the opening degree adjustment projection 3C is in the attachment-detachment stepped portion 21B. This allows the shield 3 to be removed by performing an external operation on the holding member 40 and the restriction member 50.

Shield Lock Mechanism

As shown in FIG. 4, the fixed base 20 includes a first attachment portion 22 and a second attachment portion 23. Each of the first attachment portion 22 and the second attachment portion 23 is a projection projecting toward the movable base 30. The first attachment portion 22 includes a screw hole 22A, and the second attachment portion 23 includes a screw hole 23A. Screws are inserted through the screw holes 22A and 23A and fastened to the shell 2 to fix the fixed base 20 to the shell 2. The first attachment portion 22 includes a spring seat 22W projecting toward the rear (refer to FIGS. 2 and 3).

The movable base 30 includes an attachment-detachment operation hole 33, a lock lever hole 34, a shaft support hole 35, and a movable hole 36. Further, the movable base 30 includes a spring seat 33W that is formed in front of the attachment-detachment operation hole 33 and a spring seat 36W that is formed at the rear of the movable hole 36. The first attachment portion 22 is inserted through the movable hole 36. The first coil spring 60 is supported by the spring seat 22W of the fixed base 20, which is located at the rear of the first attachment portion 22, and the spring seat 36W of the movable base 30, which is located at the rear of the movable hole 36.

Figure 5:
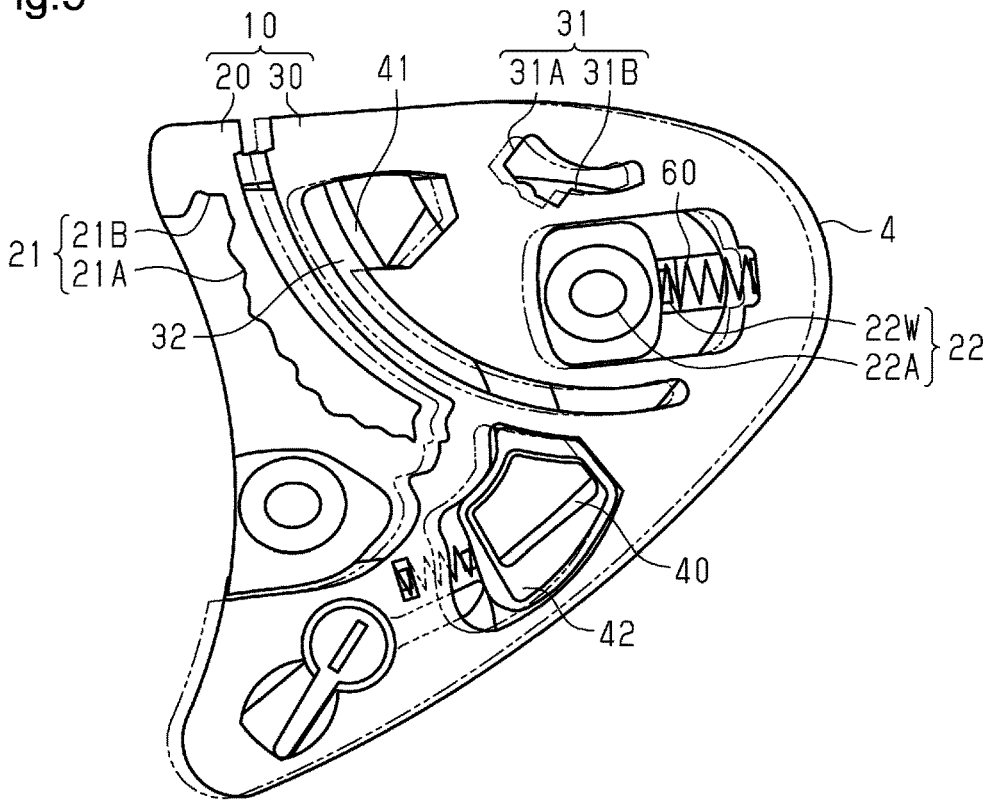
FIG. 5 is a diagram illustrating movement of a movable base included in the shield lock mechanism shown in FIG. 1.

As shown in FIG. 5, the first coil spring 60 constantly biases the movable base 30 toward the rear relative to the fixed base 20. For example, when the movable base 30 receives an operation force that counters the biasing force of the first coil spring 60, the movable base 30 is moved toward the front together with the shield 3.

For example, when the shield 3 is moved between the fully closed position and the fully open position, the opening degree adjustment projection 3C of the shield 3 alternately contacts the ridges and the valleys of the multi-serrated engagement portion 21A. When the opening degree adjustment projection 3C is moved from one valley onto an adjacent ridge, the movable base 30 receives an external force that counters the biasing force of the first coil spring 60. This moves the movable base 30 forward. Specifically, the helmet wearer applies an operation force that counters the biasing force of the first coil spring 60 to the shield 3 and moves the movable base 30. This moves the opening degree adjustment projection 3C from one valley onto an adjacent ridge and moves the shield 3. Further, when the helmet wearer applies no operation force countering the biasing force of the first coil spring 60 to the shield 3, the opening degree adjustment projection 3C stays in contact with the valley and fixes the opening degree of the shield 3.

As shown in FIG. 4, the holding member 40 includes a shield holding tab 41, an attachment-detachment lever 42, and a connecting plate 43. The attachment-detachment lever 42 is an example of an operating portion. The shield holding tab 41 is defined by an upper end of the holding member 40 and is plate-shaped. The shield holding tab 41 is sized to be pivotal in forward and rearward directions in the second attachment-detachment hole 32A. The attachment-detachment lever 42 is looped and defined by a lower end of the holding member 40. The attachment-detachment lever 42 is sized to be pivotal in forward and rearward directions in the attachment-detachment operation hole 33, which extends through the movable base 30. The lower end of the attachment-detachment operation hole 33 is defined by a pivot guide surface 33E that is curved and extends in the front-rear direction. The pivot guide surface 33E contacts the lower end wall of the attachment-detachment lever 42 to guide pivoting of the attachment-detachment lever 42.

The connecting plate 43 is a plate-shaped portion that connects the shield holding tab 41 and the attachment-detachment lever 42 in the up-down direction. The connecting plate 43 is accommodated between the fixed base 20 and the movable base 30. A groove is formed in the surface of the movable base 30 facing the fixed base 20, and the groove extends in the up-down direction to accommodate the connecting plate 43. The connecting plate 43 is guided by the side surfaces of the groove in the movable base 30 to allow pivoting of the shield holding tab 41 and the holding member 40.

When the attachment-detachment lever 42 is arranged at the rear end of its movable range, the shield holding tab 41 is arranged at the front end of its movable range. Accordingly, when an external operation force is not acting on the holding member 40, the attachment-detachment lever 42 is arranged at the rear end and the shield holding tab 41 is arranged at the front end. Thus, the holding member 40 is in a holding position.

In contrast, when an operation force from the front toward the rear is acting on the holding member 40, the attachment-detachment lever 42 is arranged at the front end of its movable range and the shield holding tab 41 is arranged at the rear end of its movable range. Thus, the holding member 40 is in an attachment-detachment position. In this manner, when an external operational force is acting on the holding member 40, the holding member 40 is in the attachment-detachment position. The direction in which the holding member 40 is moved from the holding position corresponds to the direction in which the shield holding tab 41 is moved, and the direction includes a main component in the front-rear direction.

The movable base 30 includes a plate-shaped shield sandwiching tab 32C that extends from the front end of the second attachment-detachment hole 32A toward the inner side of the second attachment-detachment hole 32A. If the shield holding tab 41 is arranged at the front end of its movable range when the second engagement tab 3B of the shield 3 is located inside the second attachment-detachment hole 32A, the second engagement tab 3B of the shield 3 will be sandwiched between the shield sandwiching tab 32C and the shield holding tab 41 so that the second engagement tab 3B of the shield 3 cannot be removed from the second attachment-detachment hole 32A. In this case, the shield 3 is continuously held by the shield lock mechanism 4. Further, if the shield holding tab 41 is arranged at the rear end of its movable range when the second engagement tab 3B of the shield 3 is located inside the second attachment-detachment hole 32A, the second engagement tab 3B of the shield 3 can be removed from the second attachment-detachment hole 32A.

The second coil spring 70 is supported by the spring seat 33W of the movable base 30, which projects toward the attachment-detachment operation hole 33, and a spring seat 42W that is arranged on the attachment-detachment lever 42 and projects toward the front. The second coil spring 70 constantly biases the attachment-detachment lever 42 toward the rear end of the movable range of the attachment-detachment lever 42. When the attachment-detachment lever 42 receives an operation force that counters the biasing force of the second coil spring 70, the attachment-detachment lever 42 is moved toward the front end of its movable range and the shield holding tab 41 is moved toward the rear end of its movable range.

The restriction member 50 includes a lock lever 51, a restriction projection 52, and a shaft portion 53. The shaft portion 53 is an example of a shaft support portion. The shaft portion 53 has the form of a disc, and the lock lever 51 and the restriction projection 52 are connected to the circumferential surface of the shaft portion 53. The shaft portion 53 is rotatably supported by the movable base 30 in the shaft support hole 35. The shaft portion 53 is rotated by an external operation that rotates the lock lever 51, and the shaft portion 53 rotates the restriction projection 52 in the same direction as the rotational direction of the lock lever 51.

The lock lever 51 is a lever extending from the shaft portion 53 toward the front. The lock lever 51 is sized to be pivotal in the lock lever hole 34 of the movable base 30. The lock lever 51 is pivoted between a canceling operation position and a restricting operation position. In the canceling operation position, the distal end of the lock lever 51 is at the uppermost position of its movable range. In the restricting operation position, the distal end of the lock lever 51 is at the lowermost position of its movable range.

The restriction projection 52 is a projection extending from the shaft portion 53 toward the rear. The restriction projection 52 is sized to be pivotal between the fixed base 20 and the movable base 30. The restriction projection 52 is pivoted between a restricting actuation position and a canceling actuation position. In the restricting actuation position, the distal end of the restriction projection 52 contacts the attachment-detachment lever 42 arranged at the rear end of it movable range. In the canceling actuation position, the distal end of the restriction projection 52 does not contact the attachment-detachment lever 42 arranged at the rear end of its movable range.

When the lock lever 51 is in the restricting operation position, the restriction projection 52 is in the restricting actuation position and the restriction member 50 is in the restricting position. The restriction member 50 in the restricting position fixes the attachment-detachment lever 42 at the rear end of its movable range to restrict movement of the holding member 40 from the holding position.

In contrast, when the lock lever 51 is in the canceling operation position, the restriction projection 52 is in the canceling actuation position and the restriction member 50 is in the canceling position. The restriction member 50 in the canceling position permits movement of the attachment-detachment lever 42 from the rear end of its movable range. This allows the holding member 40 to be moved by an external operation from the holding position to the attachment-detachment position. The direction in which the restriction member 50 is moved from the restricting position corresponds to the direction in which the restriction projection 52 is moved and the rotational direction about the shaft portion 53. The direction includes a main component in the up-down direction.

Operation

Figure 6:
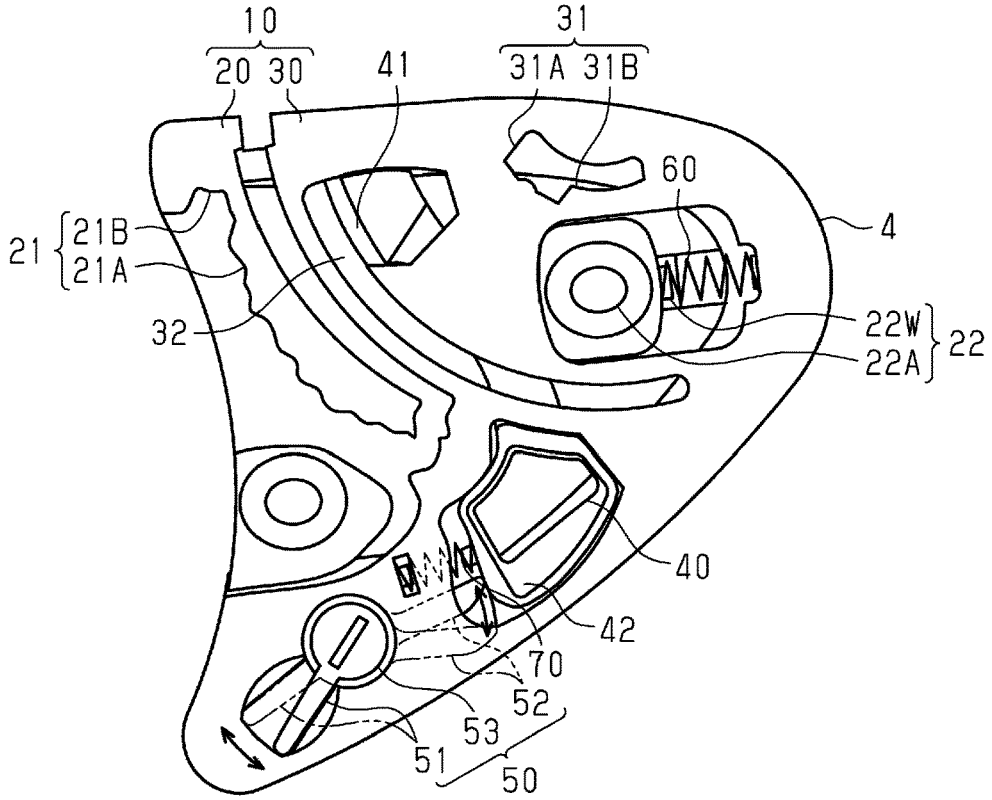
FIG. 6 is a diagram illustrating movement of a restriction member included in the shield lock mechanism shown in FIG. 1.

As shown in FIG. 6, an operation force is applied to the lock lever 51 to move the restriction member 50 between the restricting operation position (solid line) and the canceling operation position (double-dashed line). When the restriction member 50 is in the restricting actuation position, the restriction projection 52 contacts the attachment-detachment lever 42 and restricts movement of the holding member 40 from the holding position to the attachment-detachment position.

In this case, even when an impact is applied to the helmet 1, the holding member 40 will resist and not be moved by the inertial force acting on the holding member 40. Further, the direction in which the holding member 40 is moved from the holding position differs from the direction in which the restriction member 50 is moved from the restricting position. Specifically, the direction in which the holding member 40 is moved from the holding position to the attachment-detachment position differs from the direction in which the restriction member 50 is moved from the restricting position to the canceling position. This will limit the inertial force that acts on and moves both of the holding member 40 and the restriction member 50. Therefore, even when an external impact is applied to the helmet 1, the shield 3 will be continuously held by the shield lock mechanism 4.

When the restriction member 50 is in the canceling actuation position, the restriction projection 52 is separated from the attachment-detachment lever 42 to permit the movement of the holding member 40 from the holding position to the attachment-detachment position.

Figure 7:
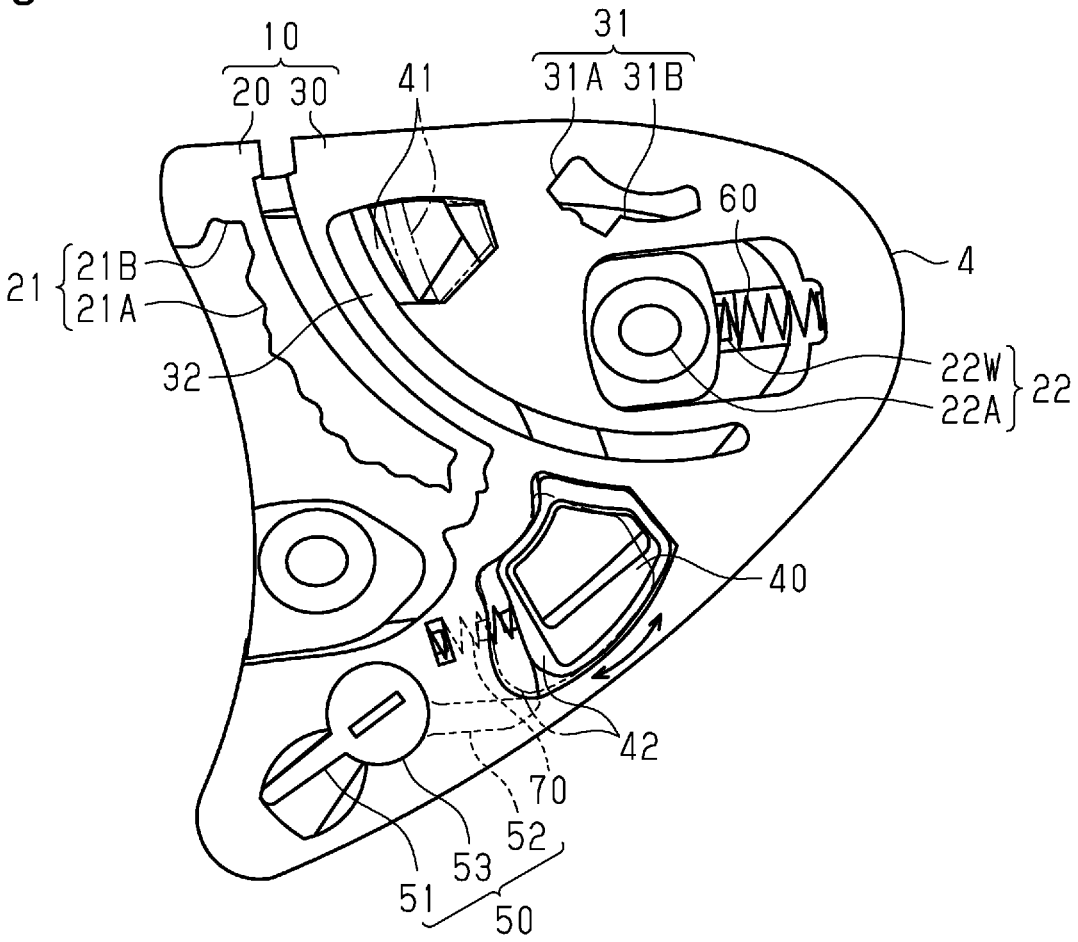
FIG. 7 is a diagram illustrating movement of a holding member included in the shield lock mechanism shown in FIG. 1.

As shown in FIG. 7, if the restriction member 50 is arranged in the canceling actuation position when the shield 3 is in the fully open position, the first engagement tab 3A will be arranged in the first attachment-detachment hole 31A and the second engagement tab 3B will be arranged in the second attachment-detachment hole 32A. In this case, when the attachment-detachment lever 42 receives an operation force that counters the biasing force of the second coil spring 70, the holding member 40 is moved from the holding position to the attachment-detachment position. This allows the shield 3 to be removed from the shield lock mechanism 4.

When attaching the shield 3 to the shell 2, first, the restriction member 50 is arranged in the canceling actuation position. Then, an operation force that counters the biasing force of the second coil spring 70 is applied to the attachment-detachment lever 42 to move the holding member 40 from the holding position to the attachment-detachment position. In this state, the first engagement tab 3A is inserted through the first attachment-detachment hole 31A, the second engagement tab 3B is inserted through the second attachment-detachment hole 32A, and then the opening degree adjustment projection 3C is arranged in the attachment-detachment stepped portion 21B. This attaches the shield 3 to the shield lock mechanism 4.

The above embodiment has the following advantages.

(1) The shield lock mechanism 4 includes the restriction member 50 that is moved by an external operation between the restricting position, at which movement of the holding member 40 from the holding position is restricted, and the canceling position, at which the restriction is canceled. Even if the helmet 1 receives a strong impact, the restriction member 50 in the restricting position restricts movement of the holding member 40. This avoids a situation in which the holding member 40 that holds the shield 3 is moved by an impact. Therefore, even if the helmet 1 receives a strong impact, the restriction member 50 in the restricting position restricts movement of the holding member 40 from the holding position to the attachment-detachment position. This will limit separation of the shield 3 from the shield lock mechanism 4.

(2) The direction in which the holding member 40 is moved from the holding position differs from the direction in which the restriction member 50 is moved from the restricting position. Accordingly, the direction in which an actuation force is applied to move the restriction member 50 from the restricting position to the canceling position differs from the direction in which an actuation force is applied to move the holding member 40 from the holding position to the attachment-detachment position. This limits movement of the holding member 40 that holds the shield 3 when an external impact is applied. Specifically, when the direction in which the holding member 40 is moved from the holding position includes direction components in the front-rear direction and the up-down direction, the front-rear direction is the large component. That is, the main component is in the front-rear direction. When the direction in which the restriction member 50 is moved from the restricting position includes direction components in the front-rear direction and the up-down direction, the up-down direction is the large component. That is, the main component is in the up-down direction. Accordingly, the main component of the actuation force for moving the restriction member 50 from the restricting position to the canceling position is orthogonal to the main component of the actuation force for moving the holding member 40 from the holding position to the attachment-detachment position. This restricts movement of the holding member 40 that holds the shield 3 when an external impact is applied. Therefore, when the helmet 1 receives an external impact, simultaneous movement of the restriction member 50 from the restricting position and the holding member 40 from the holding position will be limited. As a result, the shield 3 will not be separated from the shield lock mechanism 4.

(3) Part of the holding member 40 is sandwiched between the fixed base 20 and the movable base 30 and accommodated in the base plate 10. The holding member 40 is pivoted and moved along the curved surface defined by an inner wall in the base plate 10. Specifically, the attachment-detachment operation hole 33 in the movable base 30 of the base plate 10 includes the pivot guide surface 33E. The pivot guide surface 33E contacts the lower end wall of the attachment-detachment lever 42 of the holding member 40 to guide pivoting of the attachment-detachment lever 42. This facilitates pivoting of the holding member 40 when an external operation is performed. Further, the number of parts of the shield lock mechanism 4 is reduced from a structure in which the shield lock mechanism 4 includes a rotational shaft that rotatably supports the holding member 40 and fastens the holding member 40 to the base plate 10.

(4) Part of the restriction member 50 is sandwiched between the fixed base 20 and the movable base 30 and is accommodated in the base plate 10. The restriction member 50 includes the shaft portion 53 that is supported by the base plate 10 in the shaft support hole 35. This facilitates rotation of the restriction member 50 by an external operation. Also, the number of parts of the shield lock mechanism 4 is reduced from a structure in which the shield lock mechanism 4 includes a separate rotational shaft that rotatably supports the restriction member 50 and fastens the restriction member 50 to the base plate 10.

(5) The second coil spring 70 applies the biasing force to the attachment-detachment lever 42, and the restriction member 50 contacts the attachment-detachment lever 42 to restrict movement of the holding member 40. Further, the restriction member 50 in the canceling position is separated from the attachment-detachment lever 42 to permit movement of the attachment-detachment lever 42. Specifically, the biasing force of the second coil spring 70 and the restricting force of the restriction member 50 both act on the attachment-detachment lever 42. This allows the same attachment-detachment lever 42 to be used as long as it is mechanically durable against both the biasing force and the restricting force. As a result, the holding member 40 has a simple structure.

The above embodiment may be modified as described below.

Advantages (1) to (5) will be obtained as long as the first coil spring 60 and the second coil spring 70 are configured to apply biasing force to the movable base 30 or the holding member 40, respectively. For example, the first coil spring 60 and the second coil spring 70 may each be a biasing member such as a leaf spring or a disc spring.

The shield lock mechanism 4 is not limited to a structure in which the second coil spring 70 and the restriction member 50 both contact the attachment-detachment lever 42. The shield lock mechanism 4 may be configured so that the second coil spring 70 and the restriction member 50 apply an acting force to different portions of the holding member 40. For example, advantages (1) to (5) will be obtained even when the second coil spring 70 contacts the attachment-detachment lever 42 and the restriction member 50 contacts the shield holding tab 41.

The holding member 40 only has to be movable between the holding position and the attachment-detachment position when an external operation force is applied. For example, the holding member 40 may be supported by a rotational shaft and rotated by an external operation force. Alternatively, the holding member 40 may be a push-down switch, an on-off switch, or a screw switch. The above-mentioned structures will also have advantages (1) to (5).

In the shield lock mechanism 4, as long as the direction in which the holding member 40 is moved from the holding position differs from the direction in which the restriction member 50 is moved from the restricting position, advantage (2) will be obtained. Even with a structure in which the direction in which the holding member 40 is moved from the holding position is the same as the direction in which the restriction member 50 is moved from the restricting position, movement of the holding member 40 from the holding position will be restricted over an amount that is required to move the restriction member 50 from the restricting position before moving the holding member 40 from the holding position.

The invention claimed is:

1. A shield lock mechanism for attachment to a shell, the shield lock mechanism comprising:

a holding member configured to be moved by an external operation between a holding position at which a shield is held and an attachment-detachment position at which the shield can be attached and detached;

a biasing member configured to constantly bias the holding member toward the holding position; and a restriction member configured to be moved by an external operation between a restricting position at which movement of the holding member arranged at the holding position to the attachment-detachment position is restricted and a canceling position at which the restriction is canceled, wherein the holding member includes an operating portion configured to receive an external operation, the biasing member is configured to constantly contact the operating portion and input biasing force to the operating portion, and the restriction member is configured to directly contact the operating portion at the restricting position to restrict movement of the operating portion and configured to be separated from the operating portion at the canceling position to permit movement of the operating portion.

2. The shield lock mechanism according to claim 1, wherein a direction in which the holding member is moved from the holding position differs from a direction in which the restriction member is moved from the restricting position.

3. The shield lock mechanism according to claim 2, wherein the direction in which the holding member is moved from the holding position includes a main component in a front-rear direction, and the direction in which the restriction member is moved from the restricting position includes a main component in an up-down direction.

4. The shield lock mechanism according to claim 1, further comprising:

a base plate including two bases, wherein the holding member is at least partially sandwiched between the two bases and supported by the base plate, and the base plate includes a curved surface configured to guide pivoting of the holding member between the holding position and the attachment-detachment position.

5. The shield lock mechanism according to claim 1, further comprising:

a base plate including two bases, wherein the restriction member is at least partially sandwiched between the two bases and supported by the base plate, and the base plate includes a shaft support hole configured to guide rotation of the restriction member between the restricting position and the canceling position.

6. The shield lock mechanism according to claim 1, further comprising:

a base plate including two bases, wherein the holding member is at least partially sandwiched between the two bases and supported by the base plate, and the restriction member is at least partially sandwiched between the two bases and supported by the base plate, and the base plate includes a curved surface configured to guide pivoting of the holding member between the holding position and the attachment-detachment position, and a shaft support hole configured to guide rotation of the restriction member between the restricting position and the canceling position.

7. A helmet, comprising:

a shell;

a shield; and the shield lock mechanism according to claim 1.

* * * * *